United States Patent [19]

Ast

[11] Patent Number: 4,523,625

[45] Date of Patent: Jun. 18, 1985

[54] METHOD OF MAKING STRIPS OF METALLIC GLASSES HAVING UNIFORMLY DISTRIBUTED EMBEDDED PARTICULATE MATTER

[75] Inventor: Dieter G. Ast, Ithaca, N.Y.

[73] Assignee: Cornell Research Foundation, Inc., Ithaca, N.Y.

[21] Appl. No.: 464,256

[22] Filed: Feb. 7, 1983

[51] Int. Cl.[3] ..... B22D 11/06; B22D 19/14

[52] U.S. Cl. ..... 164/461; 164/463; 164/473

[58] Field of Search ..... 164/463, 423, 473, 55.1, 164/57.1, 58.1, 97, 461

[56] References Cited

U.S. PATENT DOCUMENTS 4,330,027 5/1982 Narasimhan ..... 164/463 X

FOREIGN PATENT DOCUMENTS 57-156863 9/1982 Japan ..... 164/463

537204 6/1941 United Kingdom ..... 164/57

*Primary Examiner*—Kuang Y. Lin

*Attorney, Agent, or Firm*—Sughrue, Mion, Zinn, Macpeak, and Seas

[57] ABSTRACT

An inert gas stream carries crystalline or amorphous phase particles which are blown at a metal melt puddle from the exterior of a crucible nozzle facing a contact surface of a continuously moving chill body and spaced slightly therefrom through which is forced a stream of molten metal. This effects homogeneous distribution of a high volume fraction of second phase particles momentarily within the melt into ribbon form prior to rapid solidification during movement away from the nozzle orifice without particle clumping. The particles may be preheated to prevent particle clumping.

4 Claims, 2 Drawing Figures

METHOD OF MAKING STRIPS OF METALLIC GLASSES HAVING UNIFORMLY DISTRIBUTED EMBEDDED PARTICULATE MATTER

The invention described herein was made in the course of work under one or more grants from the United States under Department of the Navy, Office of Naval Research, ONR Contract N00014-77-C-0564.

BACKGROUND OF THE INVENTION

This invention relates to the manufacture of continuous metal strips with an amorphous or polycrystalline metal structure containing embedded particulate matter by depositing molten metal containing particulate matter onto a rapidly moving surface of a chill body for forcing the metal through a slotted nozzle located in close proximity to the surface of the chill body, and more particularly to a method which effects homogeneous distribution of the particulate matter within the amorphous or polycrystalline structure.

Processes for the production of such continuous metal strips within an amorphous molecular or polycrystalline structure containing embedded particulate matter are the subject matter of U.S. Pat. Nos. 4,268,564 and 4,330,027 issuing May 19, 1981, and May 18, 1982, respectively.

In these patents, finely divided particulate matter of the type that is substantially inert, i.e. substantially chemically non-reactive with respect to the base metal under processing conditions, may be cast in the form of an amorphous metal strip containing incorporated particulate matter. By reference to FIG. 1 of the drawings, there is illustrated the apparatus performing one prior art method for the manufacture of a continuous metal strip 10 containing embedded particulate matter P on one side of the metal strip or ribbon 10. This is achieved by depositing molten metal containing a dispersed particulate matter onto the peripheral surface of a chill body 12 constituting an annular chill roll mounted for rotation about its axis by way of axle 14. A suitable reservoir 16 holds molten metal, the reservoir 16 being equipped with an electric induction coil 20 for heating the contents and also being provided with an agitator 22. In the process of the patents, when the density of the particulate matter is close to that of the melt, simple induction stirring provided by coil 20 is sufficient to maintain uniform dispersion of the particulate matter in the melt in conjunction with agitator 22. The reservoir 16 terminates at its bottom in a slotted nozzle 18 having a slot width somewhat less than the lateral width of the chill roll 12 with the nozzle orifice opening in close proximity to the surface of the chill roll 12. Means (not shown) function to pressurize the molten metal contained by reservoir 16 to effect forced expulsion thereof through the orifice of nozzle 18 onto the periphery of the rapidly rotating roll 12. In operation, molten metal containing dispersed particulate matter P, maintained under pressure in reservoir 16, is ejected through the orifice of nozzle 18 onto the peripheral surface of the rotating chill roll 12, whereupon it immediately solidifies downstream of the nozzle 18 to form strip 10.

Preferably, a nozzle such as nozzle 24 is employed to direct a stream of inert gas such as helium, argon or nitrogen against the peripheral surface of the chill roll at some point ahead of the slotted nozzle 18. By utilizing a stream of inert gas against the moving chill surface of the nozzle, it is possible to cast reactive alloys, which would burn readily when exposed to air in molten form onto the periphery of the roll 12, in the presence of an inert atmosphere, whereupon the reactive alloys harden without burning and prior to exposure to air remote from the deposition point at the orifice of nozzle 18. In many cases, in the absence of an inert gas flow such strips are insufficiently quenched and consequently have non-uniform properties and tend to be brittle. Such nozzles as nozzle 24 may also act as a "quench stabilizer" controlling the solidification process of the molten metal which leaves an immediately formed puddle after extrusion through the nozzle opening to solidify in contact with the periphery of roll 12.

In the production of such metallic strips there is a tendency as produced by the patents identified above for the particulate matter in the casting operation to tend to distribute spatially inhomogeneously in the ribbon and also to rise above the top surface of the strip being cast such that the particles protrude from that surface of the strip. Being firmly anchored within the metal matrix they function most satisfactorily within an abrasive strip with hard particles protruding from the upper surface thereof.

Under the processes of the above identified patents where the particles are added to the melt prior to forced extrusion through the nozzle orifice into contact with the quench surface of the roll (or endless belt), relatively long term contact exists between the base metal and the particles leading to adverse chemical reactions, melting of particles with lower melting points than the base metal, clumping of the particles and non-homogeneous distribution of the particles within the strip or ribbons results. Particularly in thick ribbons, particle distribution is such that periodic clumps of particles appear within the center. It is believed that the particles are rolled into the center of the vortex in the melt puddle and periodically released in vortex shedding. In the production of thin ribbons, the particles tend to segregate to the surface.

It is, therefore, a primary object of the present invention to provide an improved method of making strips of metallic glasses polycrystalline ribbons containing embedded particulate matter by pressure deposition of a stream of molten metal through an orifice of a nozzle into contact with the surface of a moving chill body to produce relatively thin strips or ribbons of metal and wherein the metal strips contain homogeneously dispersed particulate matter of the second phase particles which eliminates particle clumping and which allows high volume fraction of second phase material to be incorporated within the continuous strip of amorphous or polycrystalline metal with minimum contact time between the second phase particles and the molten base metal prior to solidification thereof.

SUMMARY OF THE INVENTION

The present invention is directed to an improved method of forming a continuous strip of amorphous or polycrystalline metal containing embedded particulate matter. The method comprises moving a chill body contact surface in a generally longitudinal direction at a generally constant predetermined velocity past the orifice of a slotted nozzle defined by a pair of generally parallel lips located proximate to the surface with a narrow gap therebetween, and with the orifice generally perpendicular to the direction of movement of the chill body while forcing a stream of molten metal through the nozzle orifice into contact with the surface of the moving chill body to form a melt puddle therebetween and to permit the melt to solidify thereon during movement away from the nozzle surface to form a continuous strip. The improvement comprises blowing second (crystalline or amorphous) phase particles into the melt puddle from the exterior of the melt supply nozzle to effect a homogeneous distribution of high volume fraction second phase particles within the strip without particles clumping and with minimum contact time between the second phase particles and the base melt prior to solidification thereof. An inert gas stream may be employed as a carrier for the crystalline phase particles which may be additionally functions as the quench stabilizer and the particles may be preheated to facilitate deposition of the particles without particle clumping within the melt puddle and subsequently solidifed strip.

DESCRIPTION OF THE PREFERRED EMBODIMENT

Figure 1:
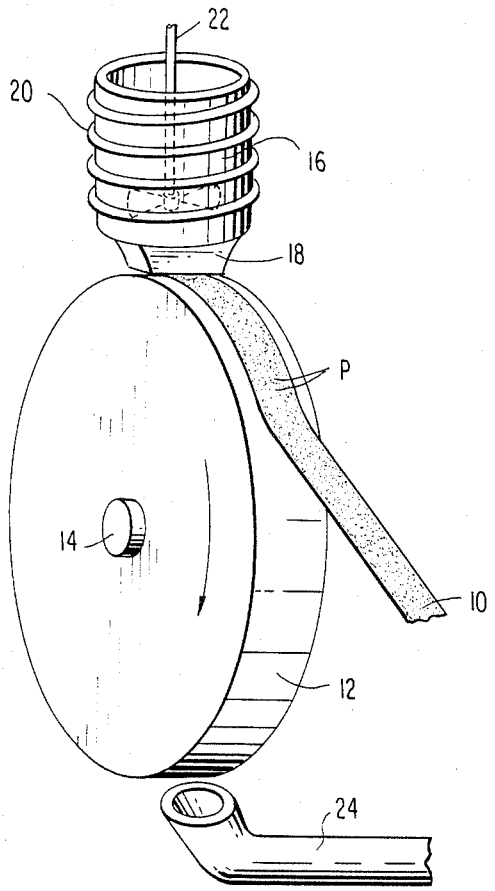
FIG. 1 PRIOR ART
FIG. 1 is a perspective view of an apparatus practicing the prior art process.
Figure 2:
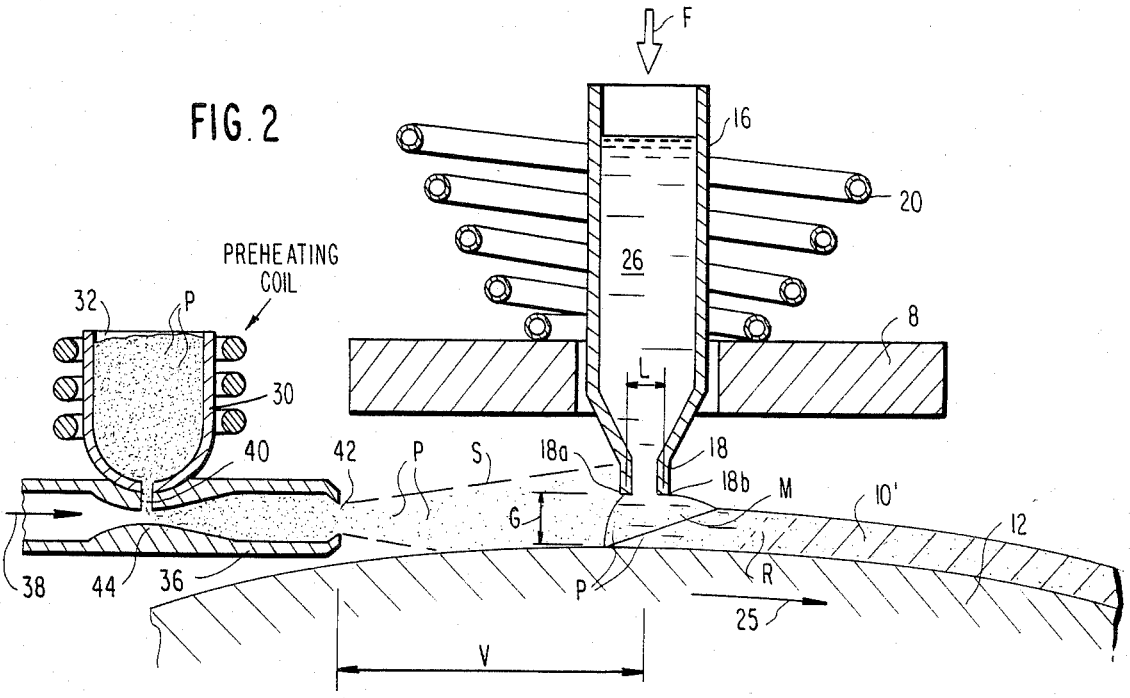
FIG. 2 is a side sectional view of an appratus practicing the process of the present invention, as a preferred embodiment thereof.

Referring now to FIG. 2, there is shown an apparatus practicing the method of the present invention in an exemplary form utilizing a number of components similar to that of the prior art, FIG. 1, which components are given the same numerical designations. In that respect, a roll 12 rotates about its axis in a clockwise direction as shown by arrow 25 beneath and in close proximity to the nozzle 18 at the lower end of crucible 16 which bears liquid metal 26 under pressure as indicated by arrow F, whereby a melt puddle M of the liquified metal contacts the periphery of the roll 12, whereupon it solidifies during rotation of the roll to form a solid ribbon 10'. An induction coil 20 melts alloy 26 assisted by copper field concentrator 8. Contrary to the prior art process, the present invention introduces the particles P, i.e. second (crystalline or amorphous) phase particles to the base metal external of the nozzle 18 by blowing the particles P into the melt puddle M by means of a gas stream S. In that respect, a hollow tube or pipe 36 has its end or orifice 42 spaced slightly from the melt puddle M on the upstream side of the nozzle 19 through which an inert gas such as helium is blown, as indicated by arrow 38. The helium gas escapes from orifice 42 of the pipe 36 with gas stream S impinging directly on the metal M.

In an exemplary form of the schematic representation, the second phase particles P are introduced to the helium gas stream S by means of a hopper or other container 30 borne by pipe 36 upstream of the discharge orifice 42, the hopper 30 having an opening 32 at the top through which particles are introduced to the hopper. Additionally, the hopper 30 has a small orifice 40 opening directly to the interior of tube or pipe 36 at venturi 44 such that high velocity the helium gas 38 aspirates particles P directly into the gas stream for discharge against the melt puddle M. The particles P are borne by the momentary liquid portion of the metal stream and subsequently find themselves within the solidified portion of the stream as at R, that is, within the solidified metal ribbon 10' as the metal (with the second phase particles homogeneously distributed therein) moves away from the orifice of crucible nozzle 18 on the periphery of roll 12.

The difference between the process of the present invention and that of the prior art, resides in the homogeneous distribution of the second phase particles P within the melt puddle M and short contact time between the particles P and the base metal 26 in molten form prior to solidification.

Further as may be appreciated, in illustrated prior art practice of FIG. 1, the tube 24 delivering a flow of inert gas for impingement upon the periphery of the roll 12 is positioned somewhat remote from the nozzle 10 delivering the liquid metal under pressure to the periphery of that roll to thus form the ribbon 10 in that embodiment. In the method of the present application, however, tube 36 is necessarily in relative close proximity to the melt puddle M and preferably on the upstream side of that melt puddle relative to the direction of movement of the roll 10 and the formed ribbon or strip 10' with the gas flow tangential to the roll 12 periphery. The physical size parameters of the molten metal delivery nozzle 18, i.e., relative to the thickness of the upstream and downstream lips **18*a* and 18*b* for nozzle 18 the width of slot L therebetween, the gap G between the nozzle orifice 42 and the periphery of roll 12, as well as the distance V between the orifice of the pipe or tube 36 delivering the particle bearing helium inert gas 38 to the melt puddle M, and the melt puddle itself are not critical to the homogeneous distribution of the particles within the solidified ribbon or strip 10'**.

As may be appreciated, all of these dimensions bear some relationship to the velocity of the periphery of roller 12 which is at relatively high velocity.

In accordance with the patents referenced previously, metal alloys which cool rapidly from the melt and form solid amorphous structures are preferred, however, exemplary metals may be formed into a polycrystalline strip containing embedded particulate matter, including aluminum, tin, copper, iron, steel, stainless steel, etc.

It has been determined that the process of the present invention has particular applicability to the preparation of metallic glasses having second phase particles of WC, TiC. Such dual phase metallic glasses have excellent mechanical, wear, and if the volume percent of the second phase can be increased above the perculation threshold of about 30 percent, they may have superconducting properties.

The subject invention has general application to the gas stream homogeneous distribution of particulate matter into a metal strip wherein the particulate matter is blown into a base melt puddle forming the amorphous or polycrystalline strip structure. The particulate matter composition may be quite diverse as long as it is substantially non-reactive during the very short time at which it is in contact with the base metal, prior to solidification of said base metal.

Specifically, a melting point above the temperature to which the metal is subject in the process is not necessarily required. Suitable metals for the second phase include especially precipitated, finely divided form, molybdenum, chromium, iron, tungsten, their carbides and oxides, ceramic particles and the like.

Particle sizes may range from between about 0.1 micron and about 10 microns. The volume or particulate matter relative to the volume of metal is not highly critical. However, it is preferred that the particulate matter does not exceed about 40 percent by weight of the combined weight of the particulate matter and the metal.

The utilization of a technique external of the crucible and nozzle feeding the liquid alloy to the surface of the roll functioning to quench the melt and create a surface of solidified metal or metallic glass results in a highly homogeneous, i.e. uniform distribution of a second phase particles within the base metal, the result of which is to improve mechanical properities such as yield strength and/or ductility. By the method of the present invention, there is minimal contact time between the second phase particles and the base metal while in liquid form, minimizing any possible chemical reaction and rendering incompatibility between the second phase particles and the base metal incidental. Further, it should be understood that the microturbulence of the boundary layer of air at the wheel of periphery is substantially reduced by the utilization of a gas quench stream S which flows in the direction of movement of the wheel at relatively the same velocity prior to impact against the melt puddle, and directed against the melt puddle upstream of the same. Cooling takes place both as a result of the gas phase contact and the high thermal conductivity of drum, principally as a result of contact between the melt puddle and the drum periphery. The fan or spray width of the gas stream S bearing the particles P is preferably equal to or slightly wider than the melt puddle. While there may be some loss of particles not captured by the melt puddle, homogeneous distribution of the second phase particles is insured. As an example only, utilizing conventional sand blasting techniques, the second phase particles may be delivered to the gas stream flowing through the particle blast nozzle by way of container 30 with a small hole 40 in its bottom opening to a venturi section 44 of the tube or pipe 36 defining the particle blasting nozzle, upstream of the nozzle opening 42. The particles may comprise tungsten carbide, titanium carbide or moly particles. The particles may be incorporated within an amorphous ribbon or a polycrystalline ribbon. The amorphous ribbon may comprise metallic glass having an atomic percentage content of nickel 80%, silicon 14%, and boron 6%. The polycrystalline ribbon may be of tin having incorporated therein tungsten carbide particles of about 10% tungsten carbide to the total percentage of tin and tungsten carbide.

While the invention has been particularly shown and described with reference to a preferred embodiment thereof, it will be understood by those skilled in the art that various changes in form and details may be made therein without departing from the spirit and scope of the invention.

What is claimed is:

1. A method of forming a continuous strip of amorphous or polycrystalline metal containing embedded particulate matter, said method comprising:

moving a chill body contact surface in a generally longitudinal direction at a constant predetermined velocity past the orifice of a slotted nozzle defined by a pair of generally parallel lips located proximate to said surface with a narrow gap therebetween and with said surface orifice generally perpendicular to the direction of movement of the surface of the chill body, and forcing a stream of molten base metal through said nozzle orifice into contact with the surface of the moving chill body to form a melt puddle therebetween and to permit the metal to solidify thereon during movement away from the nozzle orifice to form a continuous metal strip, the improvement comprising:

blowing second phase particles into the melt puddle from the exterior of said nozzle just prior to solidification on the chill body to effect a homogeneous distribution of high volume fractions of second phase particles within the strip with minimal contact time between the molten base metal and the second phase particles prior to solidification thereof;

whereby, said particulate matter is distributed spatially homogeneously in the ribbon, eliminating possible adverse chemical reactions between the particulate matter and said base metal, or melting of the particulate matter within the base metal prior to solidification thereof.

2. The method as claimed in claim 1, further comprising the step of preheating said second phase particles prior to blowing said second phase particles into the melt puddle to prevent particle clumping within said melt puddle and in said strip formed thereby .

3. The method as claimed in claim 1, wherein said step of blowing said second phase particles into the melt puddle from the exterior of said nozzle comprises blowing an inert gas stream bearing said particles across the surface of the chill body in the direction of movement of the chill body surface toward said melt puddle to effect quench stabilization of the molten metal.

4. The method as claimed in claim 2, wherein said step of blowing said second phase particles into the melt puddle from the exterior of said nozzle comprises blowing an inert gas stream bearing said particles across the surface of the chill body in the direction of movement of the chill body surface toward said melt puddle in effect quench stabilization of the molten metal.

* * * * *